United States Patent [19]

Ruckriegel

[11] 3,974,782

[45] Aug. 17, 1976

[54] SLIDE ASSEMBLY FOR EXTENDABLE TABLE

[75] Inventor: Alfred E. Ruckriegel, Jasper, Ind.

[73] Assignee: Winzeler Stamping Co., Montpelier, Ohio

[22] Filed: June 9, 1975

[21] Appl. No.: 585,418

[52] U.S. Cl. ..... 108/83; 308/3.6

[51] Int. Cl.[2] ..... A47B 1/08

[58] Field of Search ..... 248/165, 172, 188.1; 108/13, 83, 159; 308/3.6; 312/341 NR, 348; 52/645; 403/104

[56] References Cited

UNITED STATES PATENTS

| | | | |
|---|---|---|---|
| 2,606,091 | 8/1952 | Buchy et al. | 312/348 |
| 2,733,972 | 2/1956 | Diack | 312/348 |
| 3,320,003 | 5/1967 | Edelson et al. | 308/3.6 |
| 3,649,090 | 3/1972 | Dutot | 308/3.6 |
| 3,769,919 | 11/1973 | Thomas | 108/83 |
| 3,871,780 | 3/1975 | Svensson | 403/104 |

*Primary Examiner*—Robert A. Hafer

*Attorney, Agent, or Firm*—Reising, Ethington, Barnard, Perry and Brooks

[57] ABSTRACT

An extendable table of the disclosure includes an extendable frame having laterally spaced slide assemblies extending between opposite ends thereof so as to be capable of supporting table tops of different lengths. Each slide assembly includes a pair of hollow female beams projecting from opposite ends of the frame and having open ends that receive the opposite ends of a male support member which aligns and slidably interconnects the beams with each other in cooperation with an improved pad arrangement. The support member is maintained within the beams by certain pads of the arrangement that include securement portions extending downwardly through securement openings in the open ends of the beams for welding to the bottom walls of the beams. The support member is positioned in a spaced relationship with respect to the cross-sections of the beams to permit sliding movement therebetween despite variance in the size of these components along their axial lengths.

9 Claims, 9 Drawing Figures

SLIDE ASSEMBLY FOR EXTENDABLE TABLE

BACKGROUND OF THE INVENTION

1. Field of the Invention

This invention relates to an extendably table including an extendable frame for supporting table tops of different lengths, and is more particularly directed toward laterally spaced slide assemblies of the frame that interconnect the opposite ends thereof to permit the frame adjustment.

2. Description of the Prior Art

U.S. Pat. 3,769,919, issued Nov. 6, 1973 and assigned to the assignee of the present invention, discloses and claims an extendable table that may be sold with table tops of different lengths in accordance with customer preference. This table includes an extendable frame having laterally spaced slide assemblies that interconnect the opposite ends of the frame to permit its positioning for supporting either short or long table tops. Each of the slide assemblies includes a pair of hollow female beams projecting from opposite ends of the frame and having open ends that receive the opposite ends of an elongated male support member. Each end of the male support member includes a multi-sided pad assembly of multiple components secured thereto and each beam likewise includes such a pad assembly. These pad assemblies rigidify the slidable connection provided between the beams in both shortened and elongated positions of the table.

The pad assemblies of the table described above are necessary due to dimensional variances in the stock material from which the male support member and the female beams are constructed. The elongated configurations of these components and their dimensional variances along their lengths thus necessitate the use of some type of pad arrangement for slidably interconnecting them at spaced positions along their lengths. Whatever the construction of the pad arrangement that is utilized, its cost of manufacture will necessarily be reflected in the selling price of the completed table and a reduction of this cost is desirable to make the table have a competitive price in the marketplace.

SUMMARY OF THE INVENTION

An extendable table embodying the present invention includes an extendable frame having a pair of laterally spaced slide assemblies extending between opposite ends thereof, and each slide assembly incorporates an improved pad arrangement for slidably supporting the opposite ends of a male support member which is received by the open ends of a pair of hollow female beams projecting from opposite ends of the frame.

One feature of the invention is that each male support member of the extendable table slide assemblies has a first pad projecting downwardly from each of its extreme ends to slidably engage a bottom wall of the associated female beam in which it is received, and a second pad associated with the open end of each beam has an upper portion that engages the support member from above to maintain it in a spaced relationship with respect to a top wall of the beam as well as a downwardly extending securement portion that is received within a securement opening in the bottom wall of the beam and then welded thereto so as to secure the second pad to the beam such that the second pad cooperates with the first pad in rigidifying the slidable connection between the beam and the support member.

Another feature of the invention is that the pad associated with the open end of each beam preferably has a generally U-shaped configuration that opens downwardly so that its closed end provides the upper portion of the pad that engages the support member, and the side portions of this pad extend downwardly through a pair of the securement openings taking the form of a pair of laterally spaced open ended slots in the bottom wall of the beam.

Another feature of the invention is that the bottom wall of each beam adjacent its open end includes a tang located between the laterally spaced slots that receives the securement portions of the pad that is welded to the open end of the beam, and the tang is bent upwardly to engage the support member and cooperate with the pad projecting downwardly from the extreme end of the support member in maintaining a spaced relationship between the bottom wall of the beam and the support member.

The preferred construction of the slide assembly also incorporates a third pad associated with each end of the support member and secured thereto. The third pad has a U-shaped configuration that opens downwardly so that its closed upper end projects upwardly from the support member to cooperate with the pad that is welded to the open end of the beam in maintaining a spaced relationship between the top wall of the beam and the support member. The first pad at the extreme end of the beam likewise has a U-shaped configuration but opens upwardly so that its closed end projects downwardly to engage the bottom wall of the beam. Side portions of all three of the pads cooperate to maintain the support member in a spaced relationship laterally intermediate side walls of the beam. The pad welded to the open end of the beam and the pad spaced inwardly from the extreme end of the support member cooperate to provide a stop arrangement that limits outward sliding of the support member from the beam so as to insure an overlapping therebetween that provides the rigidified slidable connection between these components of the slide assembly.

The above specified features and other features, objects and advantages of the present invention are readily apparent from the following detailed description of the preferred embodiment taken in connection with the accompanying drawings.

DETAILED DESCRIPTION OF THE PREFERRED EMBODIMENT

Figure 1:
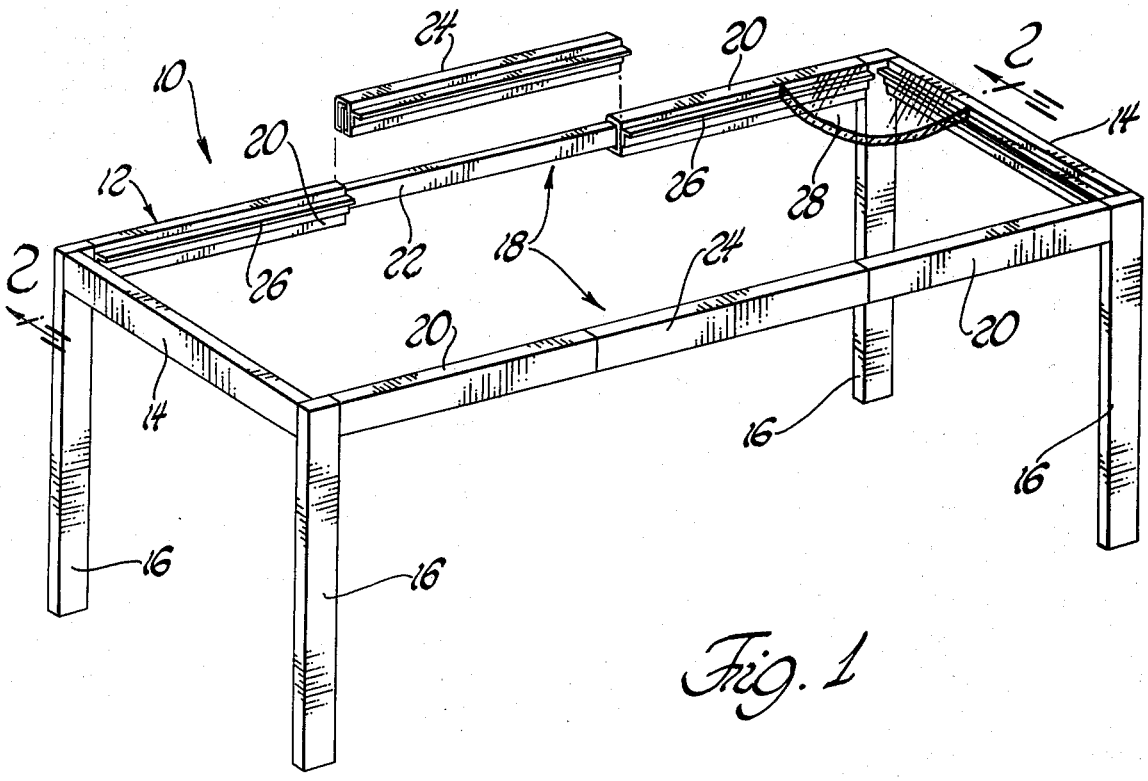
FIG. 1 is a perspective view of an extendable table embodying the invention.

With reference to FIG. 1, an extendable table embodying the invention is indicated by numeral 10 and includes an extendable frame 12 of an elongated configuration. Opposite ends of the frame 12 include laterally extending horizontal beams 14 as well as downwardly projecting legs 16 whose upper ends are interconnected by the laterally extending beams. A pair of laterally spaced slide assemblies indicated by reference numeral 18, and illustrated best in FIGS. 2 and 3, interconnect the opposite ends of the table frame. Each slide assembly includes a pair of hollow female beams 20 that are elongated and have first ends secured to associated ends of the table frame and second ends that open toward each other to receive the opposite ends of an elongated male support member 22 of the slide assembly. When the table is utilized in its elongated position, shown by FIGS. 1 and 2, the support member 22 of each slide assembly is exposed and covered by an associated cover 24 to provide continuity to the aesthetic appearance between the female beams 20. The open ends of female beams 20 abut each other when the table is utilized in its shortened position as shown in FIG. 3. The support member 22 provides a rigidified interconnection between the female beams 20 of each slide assembly so that the table may be utilized in either its elongated or shortened position. Flanges 26 on the beams 14 and 20 and on the covers 24 provide a supporting surface for the table top 28, shown partially in FIG. 1, which has a length corresponding to the length of the table which its purchaser desires and which is preferably made from sheet glass.

Figure 2:
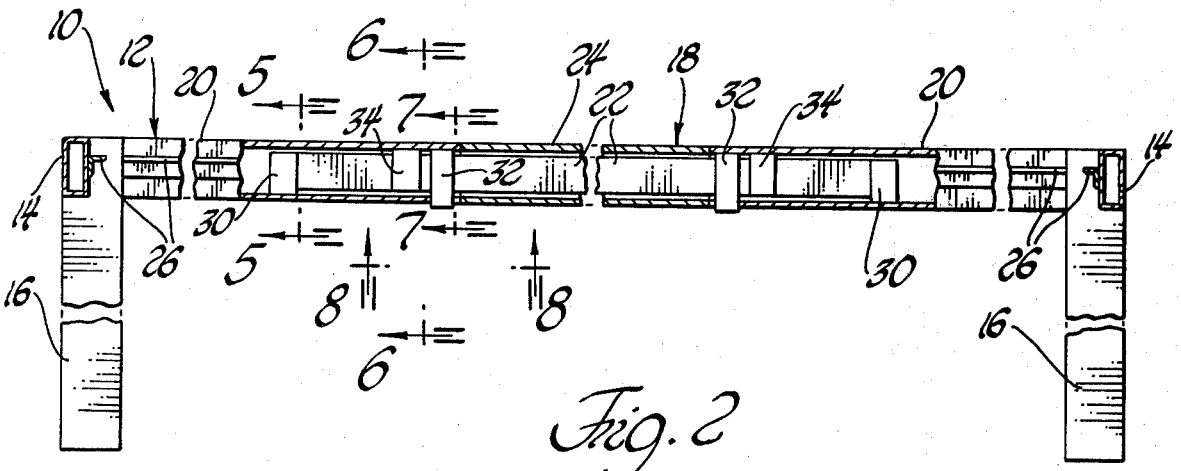
FIG. 2 is a partial sectional view taken approximately along line 2—2 of FIG. 1 and illustrates a lateral slide assembly which connects opposite ends of the table frame to position the frame in the elongated position shown.
Figure 3:
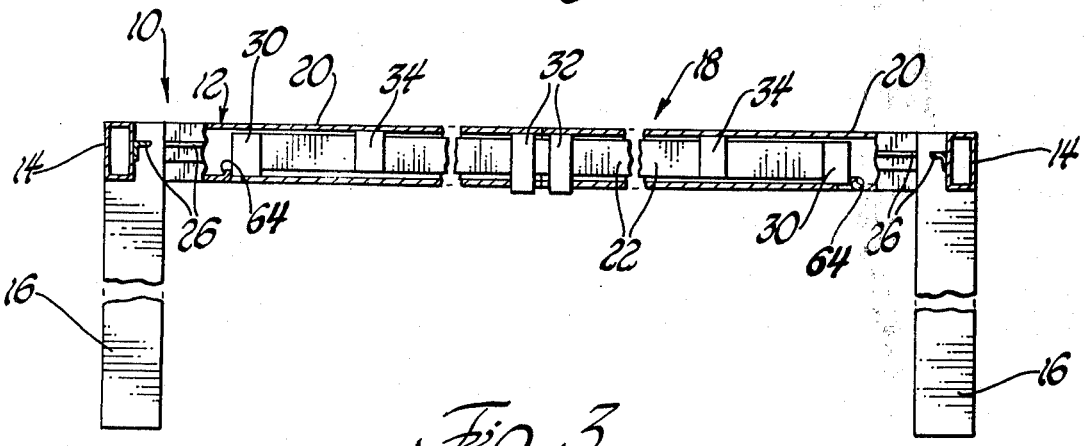
FIG. 3 is a view similar to FIG. 2 but with the table frame shown in a shortened position thereof where it is capable of supporting shorter table tops than in FIG. 2.
Figure 4:
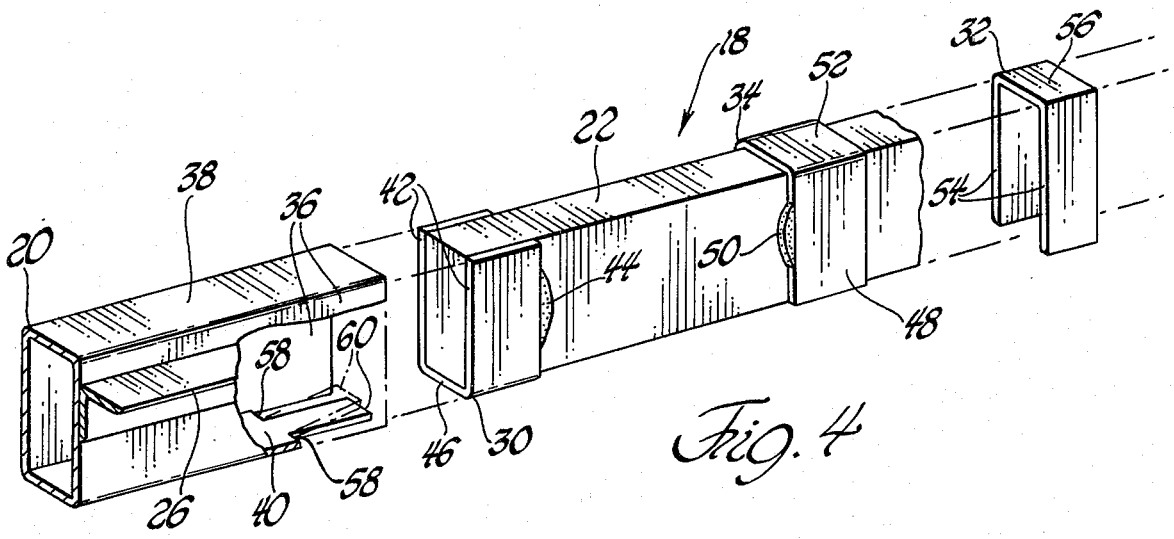
FIG. 4 is an exploded perspective view of the slide assembly, illustrating a male support member and pads associated therewith for providing slidable interconnection thereof with a hollow beam in which the support member is received.

With combined reference to FIGS. 2 through 4, each slide assembly 18 includes pads 30, 32 and 34 associated with each end of the male support member 22 and the female beam 20 in which the support member end is received. These pads are used to rigidify the interconnection between the support member and the beam and to permit a slidable adjustment that allows the table to be utilized either in its elongated position of FIGS. 1 and 2 or its shortened position of FIG. 3. Each female beam 20 is made from metallic material and has a rectangular cross-section that is elongated in a vertical direction so that, as seen in FIG. 4, the hollow construction of the beam defines side walls 36, a top wall 38, and a bottom wall 40. The male support member 22 is also made from metallic material and likewise has a vertically elongated rectangular cross-section, but of a slightly smaller size than the interior of the female beam so as to be capable of insertion into the beam.

Figure 5:
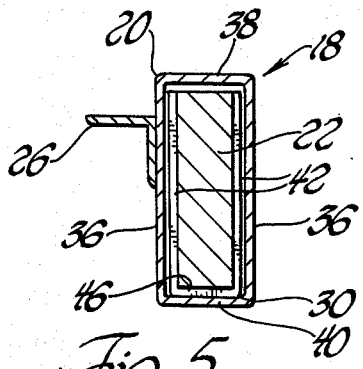
FIGS. 5, 6 and 7 are sectional views through the slide assembly respectively taken along lines 5—5, 6—6 and 7—7 of FIG. 2 and show the manner in which the pads provide slidable interconnection between the support member and the beam.

The pad 30 on each extreme end of the support member 22 has a generally U-shaped configuration including side portions 42 which, as seen in FIG. 4, are secured to the support member 22 by welds 44. The U-shaped configuration of pad 30 opens upwardly so that its closed lower end 46 projects downwardly from the lower side of the support member and engages the bottom wall 40 of beam 20 upon insertion through its open end. This engagement maintains a spaced relationship between the lower side of the support member 22 and the bottom beam wall 40 as seen in FIG. 5. The side portions 42 of pad 30 likewise space the support member 22 laterally intermediate the side walls 36 of the beam.

Figure 6:
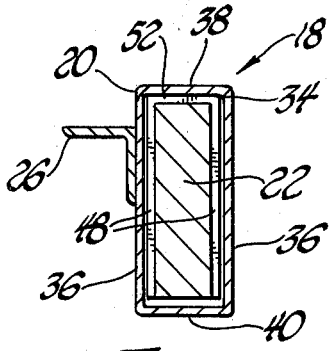

Each pad 34 also has a generally U-shaped configuration including side portions 48 that are secured to the support member 22 by welds 50, FIG. 4, at a location spaced inwardly from the pad 30. The U-shaped configuration of pad 34 opens downwardly so that its closed upper end 52 projects upwardly from the support member and, as seen in FIG. 6, engages the inner side of the top beam wall 38 to maintain a spaced relationship between the support member and this wall. The side portions 48 of pad 34 engage the side walls 36 of the beam so as to locate the support member in a spaced relationship laterally intermediate these walls in a cooperable manner with the side portions 42 of pad 30. The manner in which the pads 30 and 34 are spaced with respect to each other along the length of the support member 22 and project vertically therefrom in opposite directions permits the support member 22 to be inserted into the beam with its elongated direction oriented in an angularly skewed relationship with respect to the elongated direction of the beam. If these pads completely encircled the support member at the same axial position, rather than in the oppositely projecting and axially spaced relationship herein disclosed, the elongates axes of the beam and the support member would have to be maintained in a parallel relationship to permit the insertion of the support member into the beam. Rather, the pad construction shown in FIG. 4 permits the support member 22 to be inclined downwardly from its extreme end during the insertion into the beam 20. As the insertion proceeds, the bottom wall 40 at the open end of beam 20 engages the bottom side of the support member 22 and causes a lifting action that aligns the elongated direction of the support member in a generally parallel relationship with that of the beam. This automatic alignment facilitates the assembly operation of the components of slide assembly 18.

Figure 7:
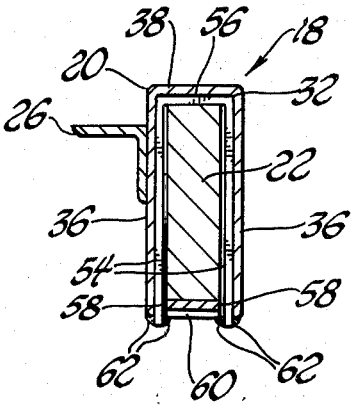
Figure 8:
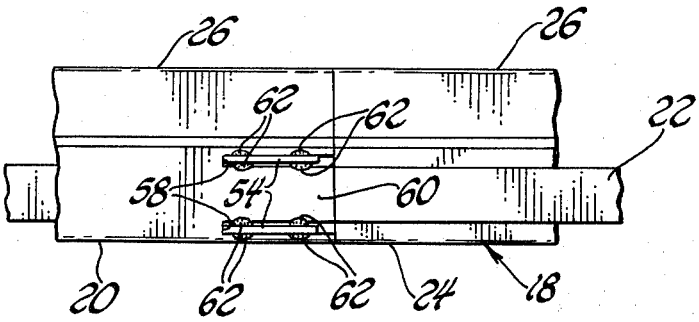
FIG. 8 is a bottom plan view taken along line 8—8 of FIG. 2.

Each pad 32 of the slide assemblies 18 is secured to the open end of its associated female beam 20 after the adjacent end of support member 22 has been inserted into the beam. The pad 32, as seen best by reference to FIGS. 4 and 7, has a generally U-shaped configuration that opens downwardly and includes side portions 54 as well as an upper closed end which provides an upper portion 56 for the pad. The pad 32 is received within the open end of its associated beam 20 so that the lower ends of its side portions 54 extend downwardly through a pair of securement openings or slots 58 in the bottom wall 40 of the beam. The slots 58 have ends that open toward the opposite end of the table frame toward which their associated beam 20 also opens. A tang 60 of the bottom beam wall 40 defines the inboard sides of slots 58 and is located between the inner sides of the lower ends on pad side portions 54, see FIG. 8. These lower ends of pad side portions 54 provide securement portions for the pad and are secured in position on both their inner and outer sides by welds 62, FIGS. 7 and 8. The tang 60 is bent upwardly prior to welding to the pad side portions 54 so that its extreme end engages the lower side of the support member 22 in a manner that cooperates with the downwardly projecting pad 30 in maintaining a spaced relationship between the support member and the bottom beam wall 40. The inner welds 62 thus secure the tang 60 in position after it has been bent upwardly. The upper portion 56 of pad 32 cooperates with the upwardly projecting pad 34 welded to the support member in order to maintain a spaced relationship between the upper beam wall 38 and the upper side of the support member. Also, the side portions 54 of pad 32 cooperate with the side portions 42 of pad 30 and the side portions 48 of pad 34 in maintaining the support member 22 in a spaced relationship laterally intermediate the side walls 36 of the beam. The rigidified interconnection between the support member and the beam in the vertical plane is more important than in the lateral plane and more spacing is possible in this lateral direction than in the vertical direction.

Figure 9:
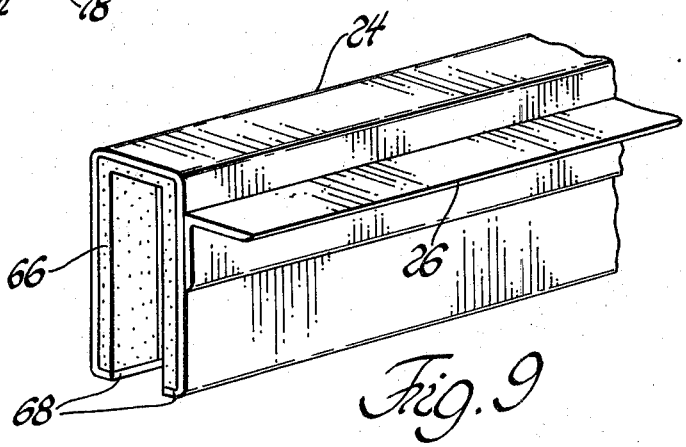
FIG. 9 is a perspective view illustrating a cover that is utilized over the support member in the elongated position of the table.

When the table is utilized in its shortened position of FIG. 3, tangs 64 bent upwardly from the bottom walls of the beams 20 center the support member 22 that extends between these beams. Movement of the table to its elongated position of FIG. 2 causes the pads 34 secured to the support member to engage the pads 32 secured to the open ends of the beams and thereby provides a stop arrangement that limits the outward sliding of the support member with respect to the beams. Consequently, the pads 30 at the extreme ends of the support member are insured of being positioned far enough into their associated beams so as to have a sufficient cantilever length from the open ends of the beams to prevent a downward force on the center of the frame from bowing the frame downwardly. The covers 24 positioned over the support members 22 in their elongated table position have pads 66, FIG. 9, that position the covers with respect to their associated support members. These pads 66 have downwardly opening U-shaped configurations whose lower ends are secured in position by spaced lower flanges 68 along the length of the covers.

While a preferred embodiment of the extendable table has been described, those skilled in the art will recognize various alternative constructions and designs for practicing the present invention as defined by the following claims.

What is claimed is:

1. An extendable table comprising: an extendable frame for supporting table tops of different lengths; the frame including a pair of laterally spaced slide assemblies interconnecting opposite ends thereof; each slide assembly including an elongated female beam of a hollow construction secured to one end of the frame so that one end of the beam opens toward the other end of the frame; each slide assembly also including an elongated male support member of a smaller cross-section than the interior of the female beam; the male support member having a first end received within the open end of the female beam and a second end secured to the other end of the frame; the female beam including vertically spaced top and bottom walls and the bottom wall defining at least one securement opening adjacent the open end of the beam; said securement opening having an end that opens toward said other end of the frame; a first pad projecting downwardly from the extreme first end of the support member so as to engage the interior of the bottom wall of the beam and maintain the support member in a spaced relationship with respect thereto; a second pad including an upper portion that engages the support member from above adjacent the open end of the beam to maintain a spaced relationship between the support member and the top wall of the beam; the second pad also including a securement portion that is inserted through the end of the securement opening so as to project downwardly through the securement opening in the bottom wall of the beam; the securement portion of the second pad being welded to the exterior side of the bottom beam wall to secure the second pad with respect to the beam; and the pads cooperating with each other to slidably support the support member with respect to the beam and rigidify the interconnection therebetween during use of the table.

2. A table according to claim 1 wherein the first and second pads include side portions that space the support member laterally intermediate the hollow cross-section of the beam.

3. A table according to claim 1 wherein the bottom wall of the beam includes a pair of the securement openings taking the form of a pair of open ended slots that open toward the other end of the frame on opposite lateral sides of a tang of the bottom wall, the second pad having a generally U-shaped configuration that opens downwardly so its closed end provides the upper portion of this pad and its side portions engaging the support member to space the support member laterally intermediate the hollow cross-section of the beam, the lower ends of the side portions of the second pad providing a pair of securement portions that are respectively received within the pair of slots after insertion of the support member into the beam, the securement portions of the second pad being welded to the exterior side of the bottom wall, and the tang of the bottom wall being bent upwardly to engage the support member from below and cooperate with the first pad in maintaining a spaced relationship between the bottom wall of the beam and the support member.

4. A table according to claim 3 wherein the tang is welded to the securement portion of the second pad after it is bent to provide support thereto.

5. A table according to claim 1 wherein each slide assembly also includes a second beam projecting from the other end of the frame so as to receive a second end of the support member, and the second beam and second end of the support member having first and second pads associated therewith to provide a rigidified slidable connection therebetween in the same manner as the other beam and first end of the support member.

6. A table according to claim 5 wherein a cover is positioned over the support member of each slide assembly between the beams thereof to provide continuity to the outer beam appearance along the length of the slide assembly in an elongated position of the table.

7. A table according to claim 1 wherein a stop arrangement is provided for limiting the outward sliding movement of the support member from the first beam.

8. A table according to claim 7 wherein the stop arrangement includes a third pad that projects upwardly from the first end of the support member to engage the top wall of the beam and space the support member with respect thereto, the third pad engaging the second pad to limit outward sliding of the support member.

9. A table according to claim 8 wherein the first and third pads have generally U-shaped configurations, with the U-shaped configuration of the first pad opening upwardly so its closed end projects downwardly, and with U-shaped configuration of the third pad opening downwardly so its closed end projects upwardly.

* * * * *